US009850903B2

(12) United States Patent
Perevozchikov

(10) Patent No.: US 9,850,903 B2
(45) Date of Patent: Dec. 26, 2017

(54) CAPACITY MODULATED SCROLL COMPRESSOR

(71) Applicant: Emerson Climate Technologies, Inc., Sidney, OH (US)

(72) Inventor: Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 119 days.

(21) Appl. No.: 14/958,524

(22) Filed: Dec. 3, 2015

(65) Prior Publication Data

US 2016/0160860 A1 Jun. 9, 2016

Related U.S. Application Data

(60) Provisional application No. 62/089,677, filed on Dec. 9, 2014.

(51) Int. Cl.
*F01C 1/02* (2006.01)
*F03C 2/00* (2006.01)
(Continued)

(52) U.S. Cl.
CPC ..... *F04C 28/26* (2013.01); *F04C 15/06* (2013.01); *F04C 18/0215* (2013.01);
(Continued)

(58) Field of Classification Search
CPC ..... F04C 18/0215; F04C 18/0261; F04C 23/008; F04C 29/0007; F04C 29/0014; F04C 29/0035; F04C 15/0049; F04C 15/06
USPC ..... 418/55.1–55.6, 57, 15, 180, 270; 417/310, 308, 299; 62/228.1, 228.5, 208, 62/210
See application file for complete search history.

(56) References Cited

U.S. PATENT DOCUMENTS 4,648,814 A * 3/1987 Shiibayashi ..... F04C 29/0007 418/55.6
5,996,364 A * 12/1999 Lifson ..... F25B 49/022 62/228.5
(Continued)

FOREIGN PATENT DOCUMENTS

CN 1246604 A 3/2000
CN 1646866 A 7/2005
(Continued)

OTHER PUBLICATIONS

Chinese Application No. 201510907094.5 first OA dated Jun. 2, 2017.

*Primary Examiner* — Theresa Trieu
(74) *Attorney, Agent, or Firm* — Harness, Dickey & Pierce, P.L.C.

(57) ABSTRACT

A system includes a compressor with an orbiting scroll member having a first end plate and a first spiral wrap. A non-orbiting scroll member has a second end plate and a second spiral wrap, the second spiral wrap forming a meshing engagement with the first spiral wrap to create a plurality of compression chambers between a suction port and a discharge port. A first port in communication with a first of the plurality of compression chambers selectively injects an injection fluid into the first of the plurality of compression chambers to increase a compressor capacity and selectively leaks a first compressed fluid from the first of the plurality of compression chambers to reduce the compressor capacity. A second port in communication with a second of the plurality of compression chambers selectively leaks a second compressed fluid from the second of the plurality of compression chambers to reduce a compressor capacity.

18 Claims, 8 Drawing Sheets

(51) Int. Cl.

| | |
|---|---|
| ***F03C 4/00*** | (2006.01) |
| ***F04C 2/00*** | (2006.01) |
| ***F04C 28/26*** | (2006.01) |
| ***F04C 18/02*** | (2006.01) |
| ***F04C 15/06*** | (2006.01) |
| ***F04C 29/00*** | (2006.01) |
| *F04C 23/00* | (2006.01) |

(52) U.S. Cl.
CPC ..... *F04C 18/0261* (2013.01); *F04C 29/0007* (2013.01); *F04C 29/0014* (2013.01); *F04C 23/008* (2013.01)

(56) References Cited

U.S. PATENT DOCUMENTS

| | | | | |
|---|---|---|---|---|
| 6,374,631 | B1 * | 4/2002 | Lifson ..... | F25B 41/04 62/117 |
| 2006/0266076 | A1 | 11/2006 | Lifson | |
| 2010/0003151 | A1 | 1/2010 | Lifson et al. | |
| 2010/0303659 | A1 * | 12/2010 | Stover ..... | F04C 18/0215 418/55.1 |

FOREIGN PATENT DOCUMENTS

| | | | |
|---|---|---|---|
| CN | 101178065 | A | 5/2008 |
| CN | 205618355 | U | 10/2016 |

* cited by examiner

CAPACITY MODULATED SCROLL COMPRESSOR

CROSS-REFERENCE TO RELATED APPLICATIONS

This application claims the benefit of U.S. Provisional Application No. 62/089,677, filed on Dec. 9, 2014. The entire disclosure of the above application is incorporated herein by reference.

FIELD

The present disclosure relates to scroll compressors, and, specifically, scroll compressors having capacity modulated systems.

BACKGROUND

This section provides background information related to the present disclosure which is not necessarily prior art.

Scroll compressors include a variety of capacity modulation mechanisms to vary operating capacity of a compressor. Capacity modulation may be used to operate a compressor at full load or part load conditions. Requirement of full or part load variation depends on seasonal variation, occupants present in a conditioned space, and/or load requirement for a refrigeration unit.

SUMMARY

This section provides a general summary of the disclosure, and is not a comprehensive disclosure of its full scope or all of its features.

A system includes a compressor. The compressor may further include an orbiting scroll member having a first end plate and a first spiral wrap. A non-orbiting scroll member has a second end plate and a second spiral wrap, and the second spiral wrap forms a meshing engagement with the first spiral wrap to create a plurality of compression chambers between a suction port and a discharge port of the orbiting scroll member and the non-orbiting scroll member. A first port is in communication with a first of the plurality of compression chambers and selectively injects an injection fluid into the first of the plurality of compression chambers to increase a compressor capacity and selectively leaks a first compressed fluid from the first of the plurality of compression chambers to reduce the compressor capacity. A second port in communication with a second of the plurality of compression chambers and selectively leaking a second compressed fluid from the second of the plurality of compression chambers to reduce a compressor capacity.

The system may further include a controller controlling a plurality of valves that control the selective injection of the injection fluid and selectively leaking of the first and second compressed fluids.

The system may further include a second port that is not leaking the second compressed fluid when the first port injects the injected fluid into the first of the plurality of compression chambers.

The system may further include a second port that is one of leaking the second compressed fluid or not leaking the second compressed fluid when the first port leaks the first compressed fluid from the first of the plurality of compression chambers to reduce the compressor capacity.

The system may further include a second port and a first port that operate to reduce compressor capacity.

The system may further include a first passage in communication with the first port and a first fitting to transport fluid between the first of the at least one compression chamber and the first fitting.

The system may further include a first conduit in communication with the first fitting and a heat exchanger, wherein the first conduit transports compressed fluid from the heat exchanger to the first fitting.

The system may further include an expansion valve positioned within the first conduit to permit or prevent communication between the heat exchanger and the first fitting.

The system may further include a second conduit in communication with the first fitting and a suction pressure region, wherein the second conduit transports fluid from the first fitting to the suction pressure region.

The system may further include a solenoid valve positioned within the second conduit to permit or prevent communication between the suction pressure region and the first fitting.

The system may further include a second passage in communication with the second port and a second fitting to leak the second compressed fluid from the second of the at least one compression chamber.

The system may further include a third conduit in communication with the second fitting and a suction pressure region, wherein the third conduit transports fluid from the second fitting to the suction pressure region.

The system may further include a second solenoid valve positioned within the third conduit to permit or prevent communication between the second fitting and the suction pressure region.

The system may further include a first passage in communication with the first port and a first fitting to transport fluid between the first of the plurality of compression chambers and the first fitting. A first conduit may be in communication with the first fitting and a heat exchanger, wherein the first conduit transports compressed fluid from the heat exchanger to the first fitting. A second conduit may be in communication with the first fitting and a suction pressure region, wherein the second conduit transports fluid from the first fitting to the suction pressure region. A third solenoid valve may selectively permit or prevent flow between the first conduit and the suction pressure region, between the second conduit and the suction pressure region, or both the first and second conduits and the suction pressure region.

The system may further include at least one of a first port and a second port being a single larger port or a plurality of small ports grouped together.

The system may further include a first port is located radially outward relative to a second port.

Another compressor may include a first scroll member having a first end plate and a first spiral wrap. A second scroll member includes a second end plate and a second spiral wrap, wherein the second spiral wrap forms a meshing engagement with the first spiral wrap to create a plurality of compression chambers between the first scroll member and the second scroll member. A first port injects a fluid into a first of the plurality of compression chambers to increase a compressor capacity or leaks compressed fluid from the first of the plurality of compression chambers to reduce the compressor capacity. A second port leaks compressed fluid from a second of the plurality of compression chambers to reduce the compressor capacity.

The compressor may further include a first port that both injects the fluid into the first of the plurality of compression chambers to increase the compressor capacity and leaks compressed fluid from the first of the plurality of compression chambers to reduce the compressor capacity.

The compressor may further include a first port that is a vapor injection port in communication with the first of the plurality of compression chambers and injects the fluid into the first of the plurality of compression chambers to increase the compressor capacity, and a second port that is a bypass port in communication with the second of the plurality of compression chambers and leaks compressed fluid from the second of the plurality of compression chambers to reduce the compressor capacity.

The compressor may further include a first port that is positioned radially outward relative to a second port.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

A capacity modulation system according to the present disclosure allows for several levels of capacity reduction in a compressor. The capacity modulation system utilizes an economized vapor injection (EVI) port and a bypass port to either inject vapor fluid into the compressor to increase capacity, and/or leak compressed fluid from the compressor to reduce capacity. The positions of the EVI and bypass ports within the compressor and the areas of the EVI and bypass ports determine the amount of capacity increase or reduction that can be achieved. While the capacity modulation system is described and illustrated as modifying the capacity of a scroll compressor, it is understood that the concepts of the capacity modulation system may be applied to other compressors as well. For example only, the concepts of the capacity modulation system may be applied to a screw compressor.

Figure 1:
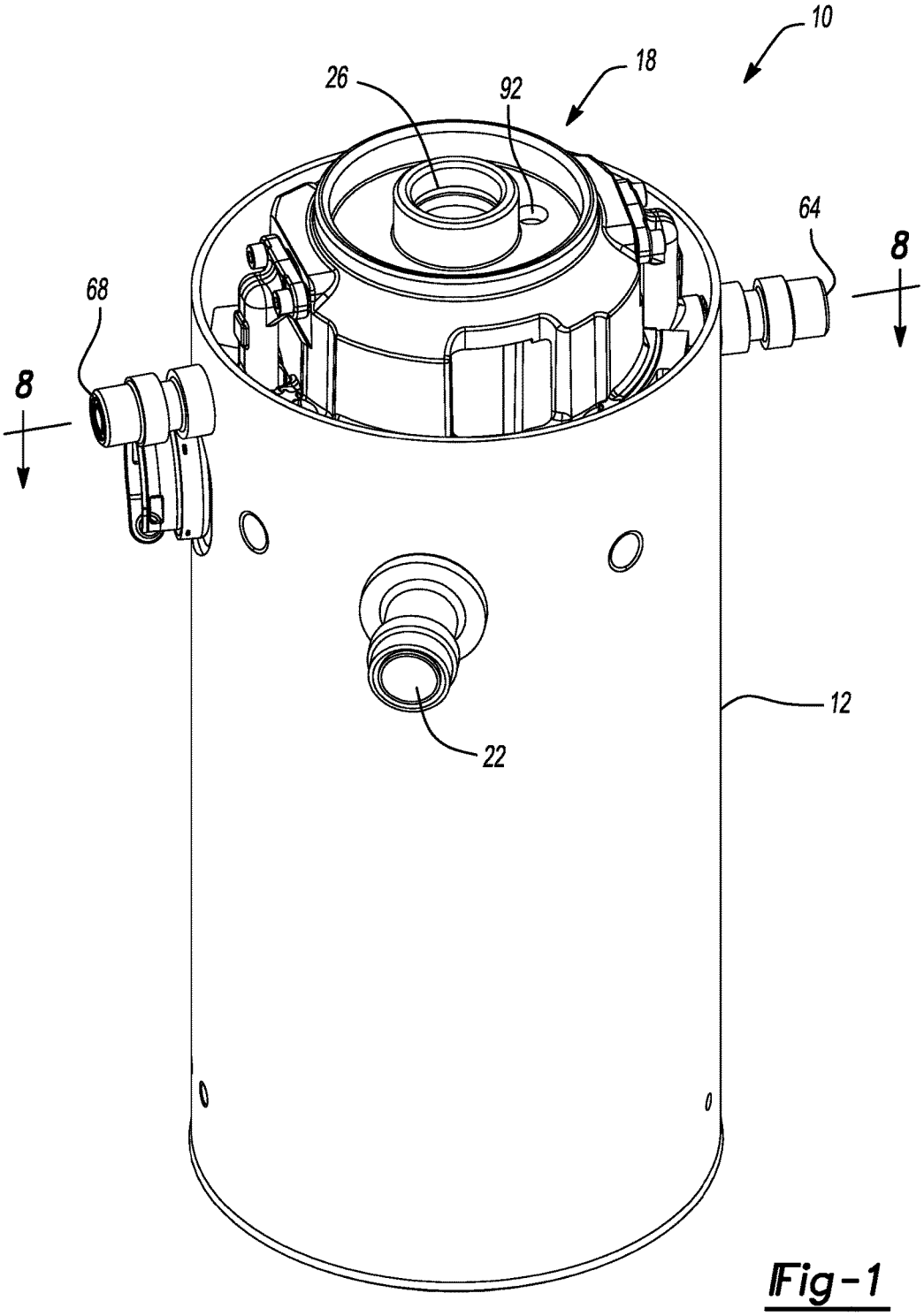
FIG. 1 is a perspective view of a compressor according the present disclosure.
Figure 2:
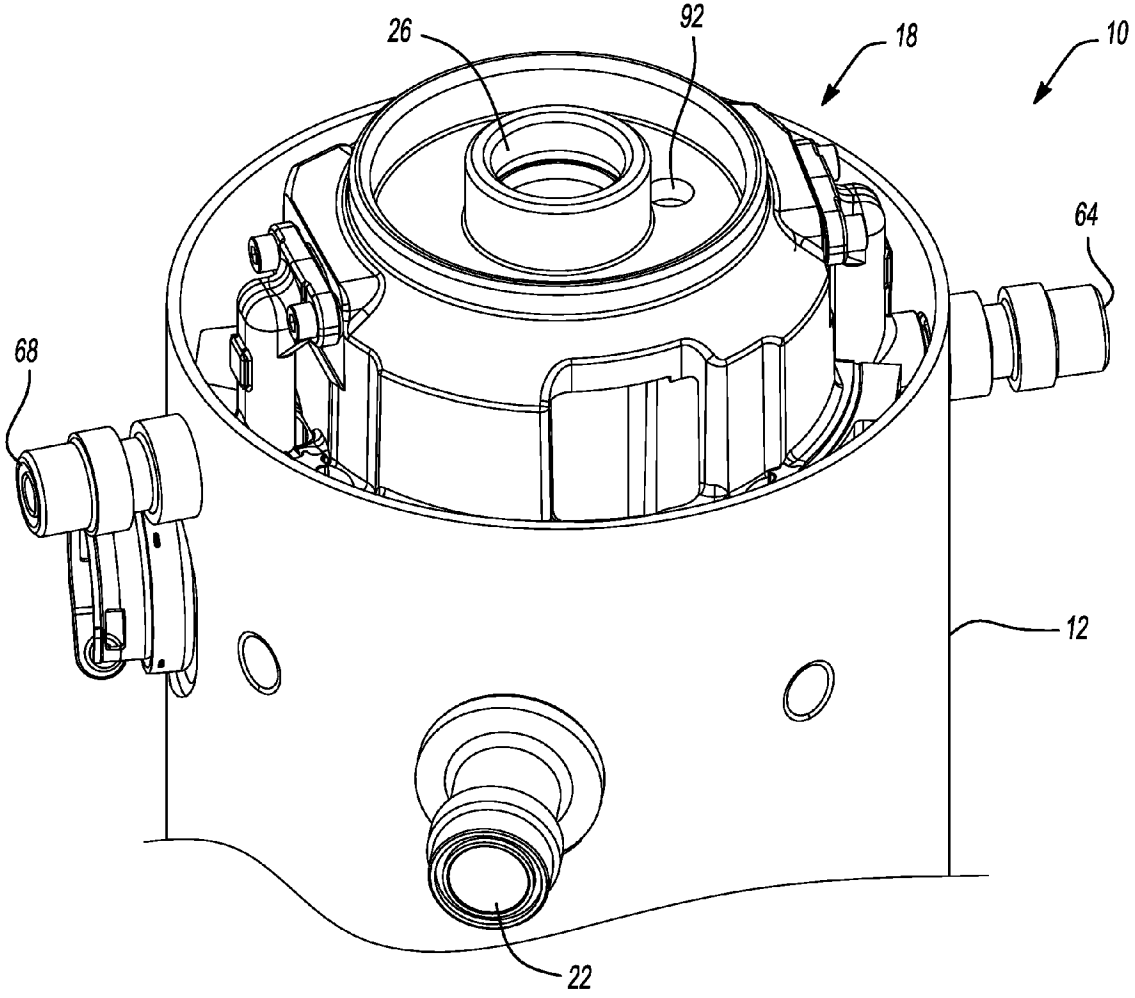
FIG. 2 is a detail perspective view of the compressor of FIG. 1.

With initial reference to FIGS. 1 and 2, a compressor 10 may include a hermetic shell assembly 12 housing a compression mechanism 18. The compression mechanism 18 may be a scroll compressor. The shell assembly 12 provides access to the compression mechanism 18 through a suction port 22, a discharge port 26, and a plurality of other ports 30, 34. In the illustrated embodiment of FIGS. 4-5, port 30 is an EVI-bypass combination port (referred to hereafter as an EVI port) and port 34 is a bypass port. While port 30 is illustrated and described ad an EVI-bypass combination port and port 34 is illustrated and described as a bypass port, ports 30, 34 may be economized vapor injection (EVI) ports, bypass ports, or a combination thereof.

Figure 3:
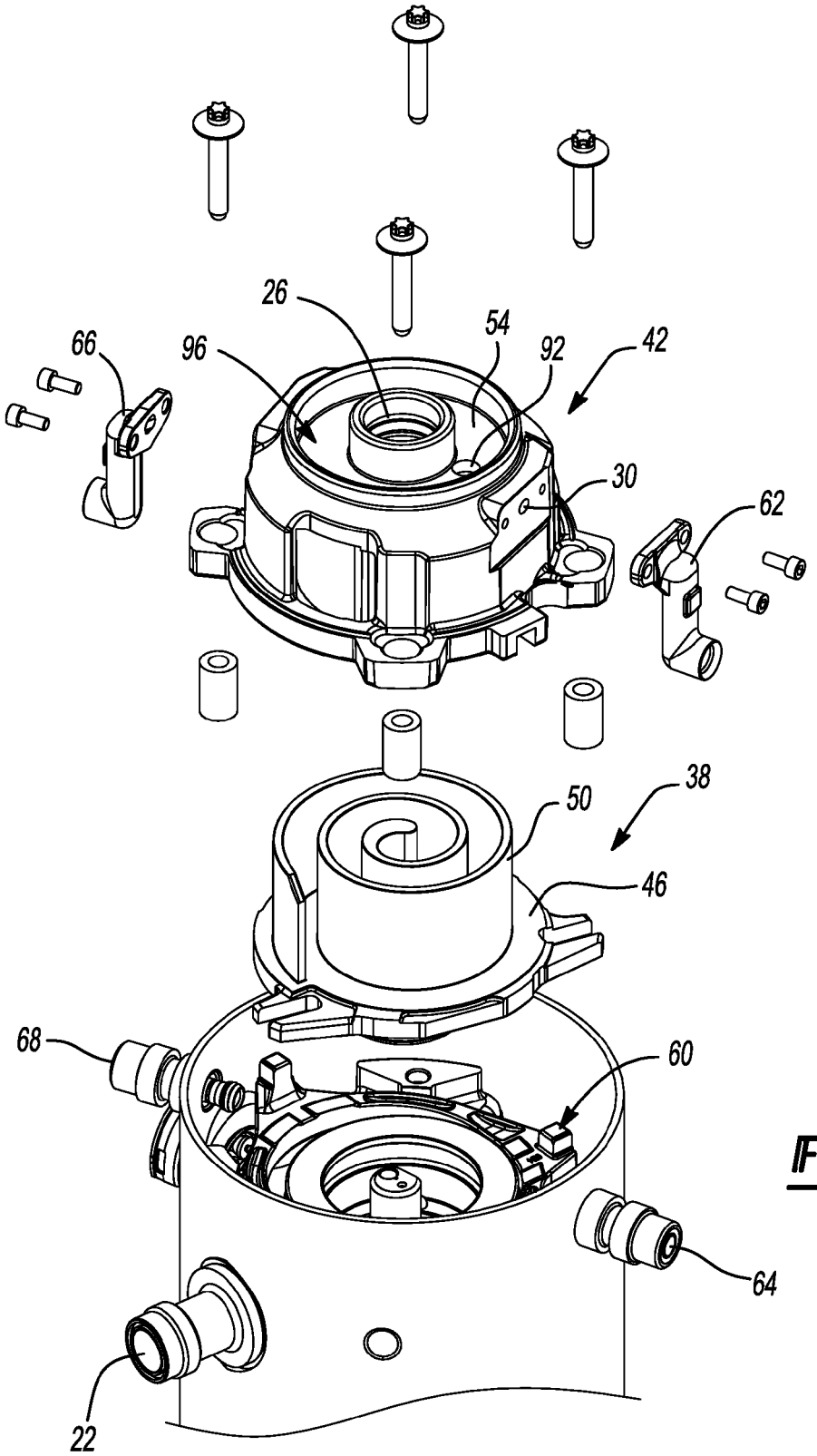
FIG. 3 is an exploded view of the compressor of FIG. 1.

With additional reference to FIG. 3, the compression mechanism 18 may generally include an orbiting scroll 38 and a fixed, or non-orbiting, scroll 42. The orbiting scroll 38 may include an end plate 46 having a spiral vane or wrap 50 on the upper surface thereof. The non-orbiting scroll 42 may include an end plate 54 having a spiral wrap 58 on a lower surface thereof which forms a meshing engagement with the wrap 50 of the orbiting scroll 38, thereby creating a series of pockets, or compression chambers (FIGS. 4-7). An Oldham coupling 60 may be engaged with the orbiting and non-orbiting scrolls 38, 42 to prevent relative rotation therebetween.

Referring additionally to FIGS. 4-7, the scroll wraps 50, 58 interfit and surround discharge port 26. The orbiting scroll 38 orbits relative to the non-orbiting scroll 42 and the scroll wraps 50, 58 selectively trap refrigerant in the series of pockets, or compression chambers, which compress the refrigerant toward discharge port 26. The EVI and/or bypass ports, 30, 34 are formed in the non-orbiting scroll 42 to selectively inject an injected fluid into one of the compression chambers or leak a compressed fluid from one of the compression chambers to increase or reduce compressor capacity, as will be described in relation to FIGS. 9-11. The EVI and/or bypass ports 30, 34 may be a single larger port (FIGS. 4 and 5) or the EVI and bypass ports 30, 34 may be a plurality of small ports grouped together (as shown by items 78, 82 in FIGS. 6 and 7).

An EVI passage 62 provides communication between the EVI port 30 and the exterior of the shell 12, and a bypass passage 66 provides communication between the bypass port 34 and the exterior of the shell 12. An EVI fitting 64 is disposed on the exterior of the shell 12 and communicates with the EVI port 30 through the EVI passage 62. A bypass fitting 68 is disposed on the exterior of the shell 12 and communicates with the bypass port 34 through the bypass passage 66. Because of the location of the EVI port 30 and bypass port 34 within the non-orbiting scroll 42, the EVI fitting 64 and bypass fitting 68 may be disposed on approximately opposing sides of the shell 12.

Figure 4:
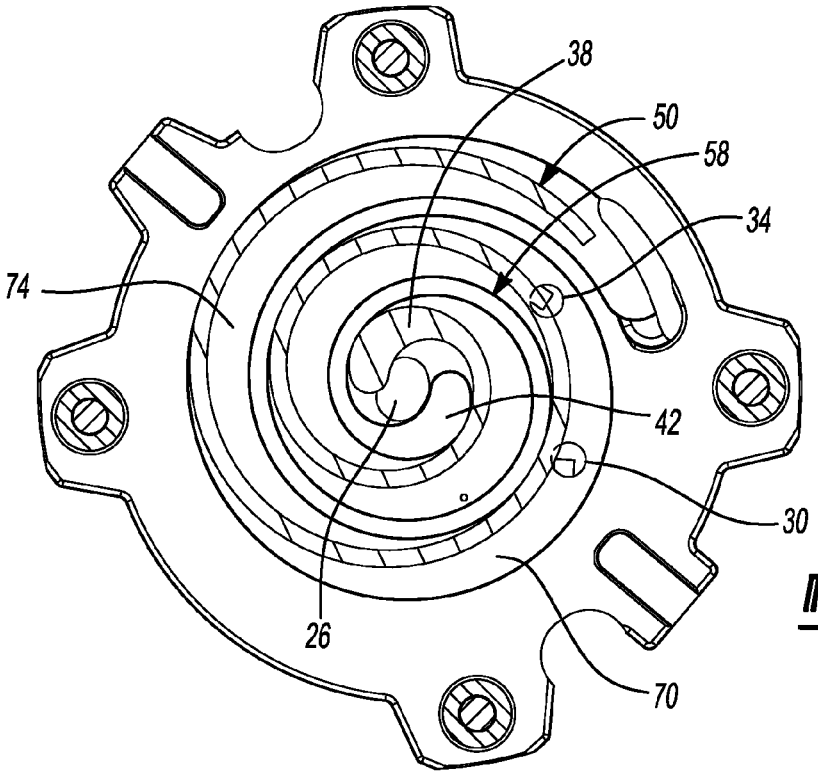
FIG. 4 is a section view of the compressor of FIG. 1 illustrating the compressor in an operational state.
Figure 5:
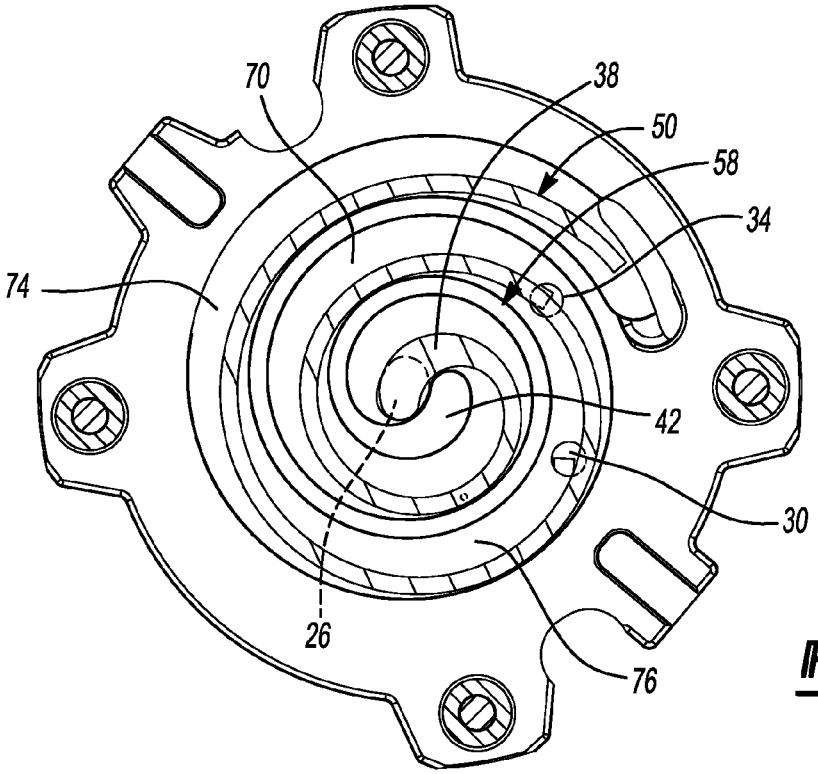
FIG. 5 is a section view of the compressor of FIG. 1 showing the compressor in a different operational state.

Now referring to FIG. 4, the EVI port 30 is uncovered by the orbiting scroll 38 at about the same time that a compression chamber 70 is sealed from a zone 74 that communicates with suction port 22 (e.g., a suction pressure zone.). As shown in FIG. 5, as the orbiting scroll 38 continues to move relative to the non-orbiting scroll 42, bypass port 34 remains partially in communication with compression chamber 70, but is mostly covered by the orbiting scroll 38. EVI port 30 moves into communication with compression chamber 76.

Figure 6:
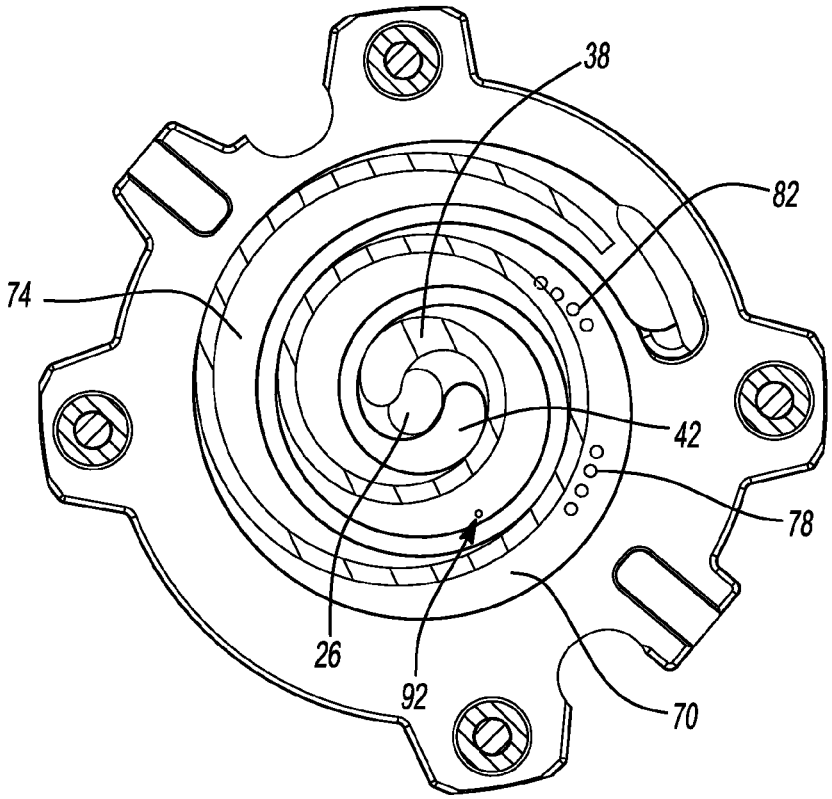
FIG. 6 is a section view of another compressor in an operational state.
Figure 7:
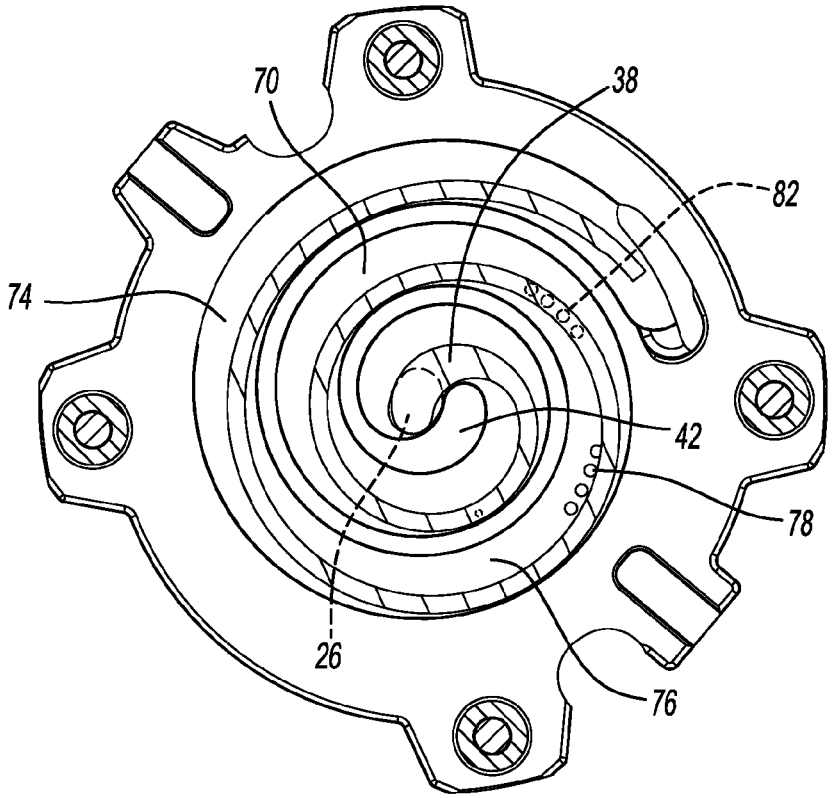
FIG. 7 is a section view of the compressor in FIG. 6 in a different operational state.

Now referring to FIGS. 6 and 7, EVI port 30 and bypass port 34 may be series of small ports 78, 82, respectively. By using a series of small ports 78, 82, different variability in compressor capacity can be achieved. FIG. 6 illustrates the EVI ports 78 are uncovered by the orbiting scroll 38 at about the same time that the compression chamber 70 is sealed from the zone 74 that communicates with suction port 22 (e.g., a suction pressure zone), similar to FIG. 4. FIG. 7 illustrates bypass ports 82 covered by the orbiting scroll 38 as the orbiting scroll 38 continues to move relative to the non-orbiting scroll 42; whereas EVI ports 78 move into communication with compression chamber 76.

Figure 8:
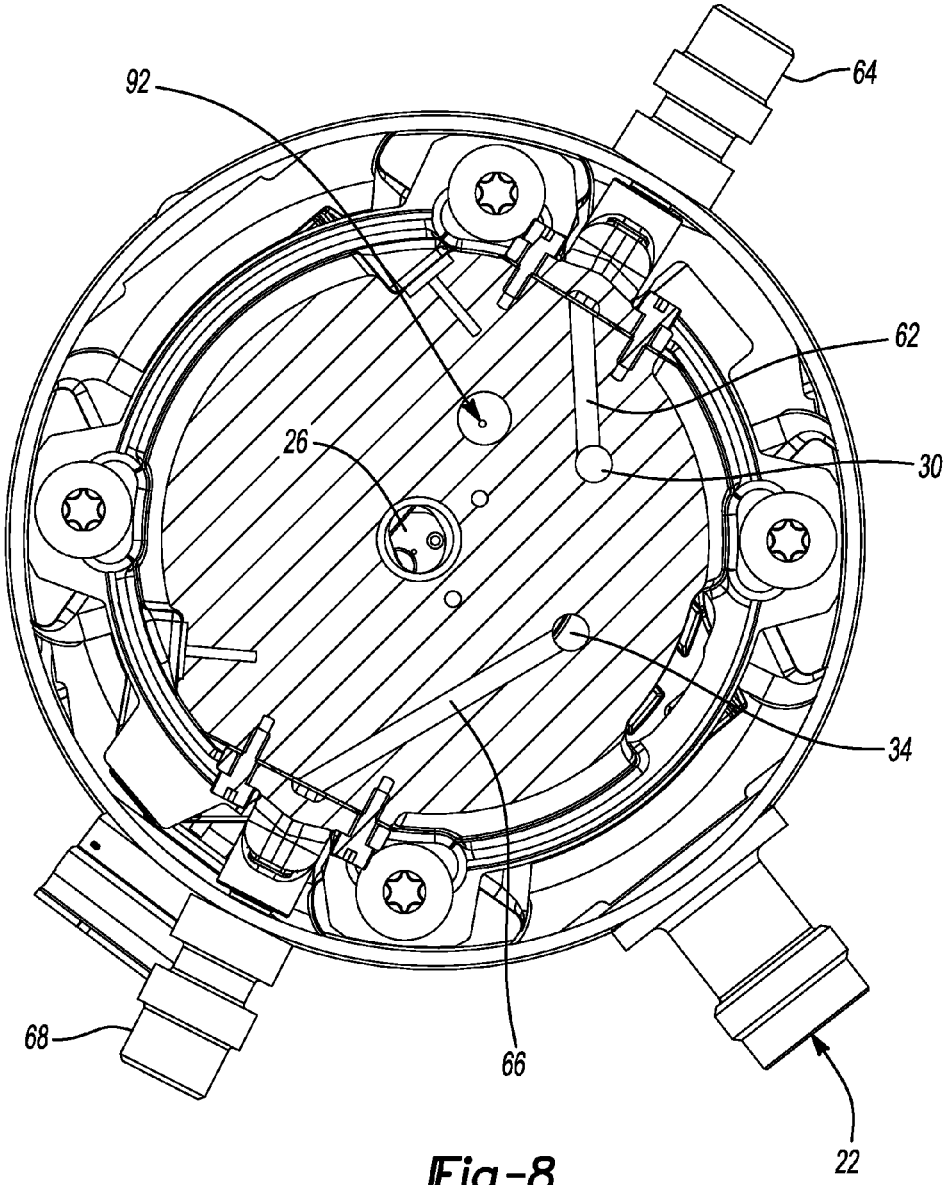
FIG. 8 is another section view of the compressor of FIG. 1.
Figure 9:
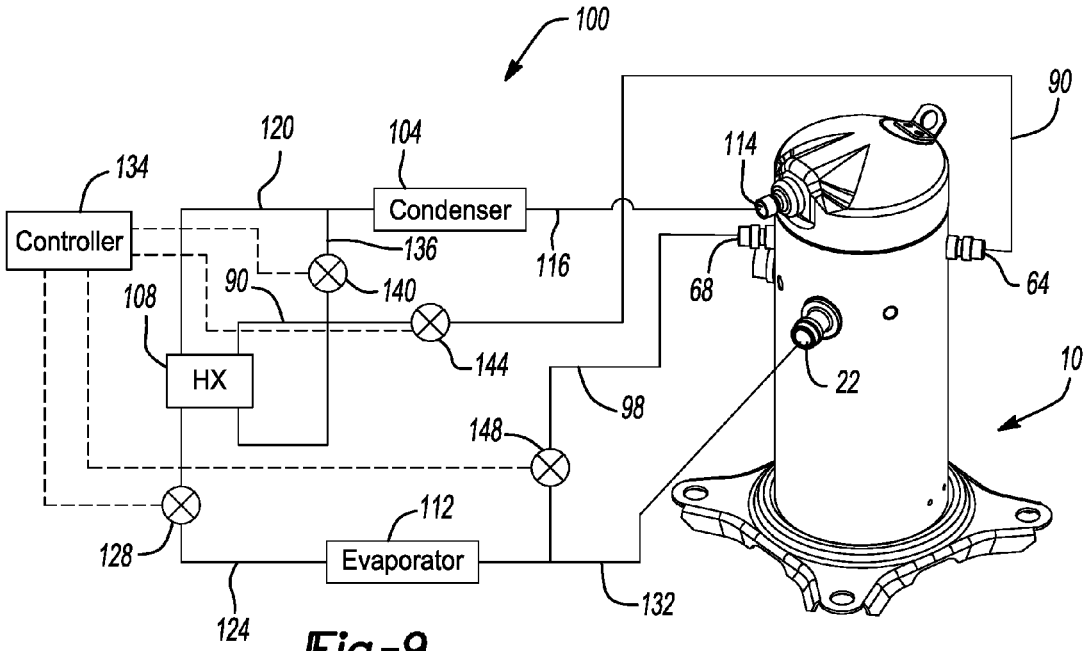
FIG. 9 is schematic view of a refrigeration system incorporating the compressor of FIG. 1.
Figure 10:
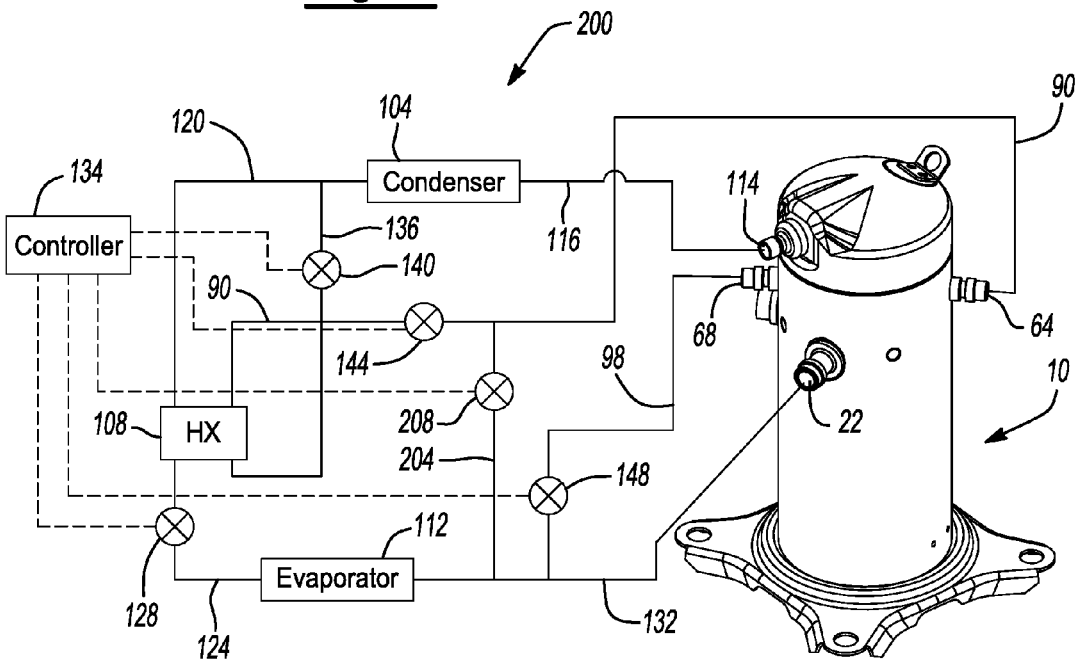
FIG. 10 is a schematic view of another refrigeration system incorporating the compressor of FIG. 1.
Figure 11:
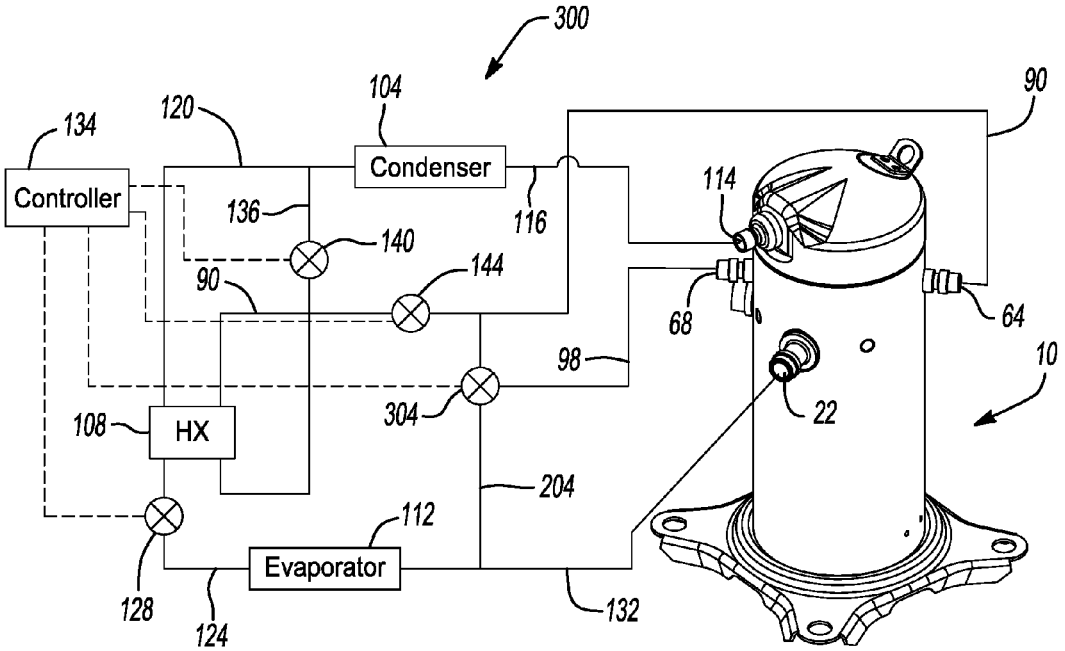
FIG. 11 is a schematic view of another refrigeration system incorporating the compressor of FIG. 1.

As shown in FIG. 8, EVI passage 62 communicates with EVI port 30, and bypass passage 66 communicates with bypass port 34. EVI fitting 64 engages the exterior surface of the shell 12 and communicates between the EVI port 30 and a line 90 external to the compressor 10 (FIGS. 9-11). As illustrated in conjunction with FIGS. 4-5, EVI port 30 may be positioned closer to the suction port than the bypass port 34. This means that the EVI port 30 may be positioned or located radially outward relative to the bypass port 34. Bypass fitting 68 engages the exterior surface of the shell 12 and communicates between the bypass port 34 and a line 98 external to the compressor 10 (FIGS. 9-11). While lines 90 and 98 are referred to as lines throughout the spec, lines 90 and 98 may also be referred to as fluid conduits.

As illustrated in conjunction with FIGS. 4-5, EVI port 30 may be positioned closer to the zone 74 communicating with suction port 22 than the bypass port 34. By moving the bypass port 34 closer to the discharge port 26, capacity is further reduced because a portion of the wraps 50, 58 compressing the fluid are removed. The location of the bypass port 34 is optimized by taking into consideration the axial balance of the scrolls 38, 42 and the desired capacity reduction. The closer the bypass port 34 is positioned to the discharge port 26 and the further the bypass port 34 is positioned from the EVI port 30, the more capacity reduction is achieved. However, the scroll 38, 42 instability also increases as the bypass port 34 is positioned closer to the discharge port 26, because a bleed hole 92 (FIG. 6) for a biasing chamber 96 (FIG. 3) must apply enough force against the non-orbiting scroll 42 to maintain sealing between the compression pockets.

In some embodiments, only one port is necessary for both EVI functions and bypass functions. In the embodiments illustrated in the Figures, the EVI port 30 is used for both EVI functions and bypass functions, and the bypass port 34 is used for bypass functions. Because the EVI port 30 and the bypass port 34 do not communicate in reducing the capacity of the compressor 10, there is no significant penalty in full load conditions. Further, the capacity reduction is limited by the size of the port 30, 34 and therefore, two ports enable a larger capacity reduction. Further, the capacity reduction of the compressor 10 is limited by the size of the port 30, 34 and therefore two ports enable a larger capacity reduction than a single port.

Now referring to FIGS. 9-11, several embodiments for capacity reduction in the compressor 10 are illustrated. During operation, multiple levels (for example, four) of capacity may be achieved. The compressor 10 is a portion of a refrigerant system 100, 200, 300 also having a condenser 104, a heat exchanger (HX), or flash tank, 108, and an evaporator 112. A discharge outlet 114 is in communication with a line 116 leading to the condenser 104. The condenser 104 communicates with the heat exchanger 108 through a line 120. Beyond the heat exchanger 108, fluid flows through a line 124 and a valve 128 in communication with the evaporator 112. The evaporator 112 is in communication with the suction port 22 through a line 132.

A controller 134 may operate to control the opening and closing of a plurality of valves, as further described below. While only a single controller 134 is illustrated and described as controlling each of the valves, one or more of the plurality of valves may be controlled by one or more additional controllers for selectively opening and closing the valves to provide liquid fluid injection, vapor fluid injection and/or leak compressed fluid, thereby allowing capacity modulation of the compressor.

Referring specifically to FIG. 9, when operating at an economized capacity, fluid may exit the compressor through the discharge outlet 114 into line 116. After passing through the condenser 104, the fluid may enter a line 136 containing a valve 140. Valve 140 may be an expansion device, such as an electronic expansion valve, a thermostatic expansion valve, a capillary tube, or a float valve. Valve 140 may vary in the amount that it is open, such that it variably controls the amount of fluid passing through. The fluid continues in line 136 and passes through heat exchanger 108 and into line 90. Line 90 may further contain an optional solenoid valve 144. The fluid is injected back into compressor 10 through EVI port 30 to increase the compression of the fluid within the various compression pockets of wraps 50, 58. In any emobdiment the injected fluid that is injected back into compressor 10 through EVI port 30 may be a vapor fluid or a liquid fluid.

Valve 148 along line 98 between bypass port 34 and line 132 may be selectively closed to prevent reduction in capacity. Alternatively, valve 148 may be located inside the compressor 10 to thereby selectively leak refrigerant from the bypass port 34 into the suction pressure zone. With this alternative, the bypass fitting 68 and line 98 are not used because the refrigerant will leak directly back to the suction pressure zone from the bypass port 34 through the bypass passage 66. By injecting fluid into compressor 10 through EVI port 30, capacity of the compressor 10 may be increased over the capacity of the compressor 10 without the fluid injection.

When operating at a full capacity, valves 140, 144, and 148 may be closed such that the fluid follows a path as previously described from the discharge outlet 114, to the condenser 104, to the heat exchanger 108, to the evaporator 112, and back through the suction port 22.

When operating at a first lower level of capacity, valves 140 and 144 may be selectively closed while valve 148 may be selectively opened to utilize the bypass port 34. Valve 148 may be a solenoid valve for opening and closing line 98 communicating with bypass port 34. During operation, a portion of partially compressed fluid exits the compressor 10 through the bypass port 34 before reaching full compression and discharge port 26. The amount of capacity reduction is dependent on the amount of partially compressed fluid exiting the compressor 10. The amount of partially compressed fluid exiting the compressor 10 is dependent on the area and location of the bypass port 34. The partially compressed fluid exits the bypass port 34 into line 98. The partially compressed fluid passes through valve 148 and into line 132 to reenter the suction port 22.

As previously mentioned, controller 134 may control the opening and closing of valves 128, 140, 144 and 148 to selectively open and close communication with the EVI port 30 and the bypass port 34. In other aspects, one or more of valves 128, 140, 144, and 148 may be controlled by one or more additional controllers.

Now referring specifically to FIG. 10, system 200 may contain many of the same features as system 100 including, but not limited to, condenser 104, heat exchanger 108, evaporator 112, valves 128,140, 144, 148, and lines 90, 98, 116, 120, 124, 132, and 136. Line 204 and valve 208 may communicate between line 90, thus EVI port 30, and line 132, thus suction port 22.

When operating at an economized capacity, fluid may exit the compressor through the discharge outlet 114 into line 116. After passing through the condenser 104, the fluid may enter line 136 containing valve 140. The fluid continues in line 136 and passes through heat exchanger 108 and into line 90. Line 90 may further contain optional valve 144. The fluid is injected back into compressor 10 through EVI port 30 to increase the compression of the fluid within the various compression pockets of wraps 50, 58. The injected fluid that is injected back into compressor 10 through EVI port 30 may be a vapor fluid, a liquid fluid or a combination vapor-liquid fluid (e.g. wet vapor).

Valve 148 along line 98 and valve 208 along line 204 may be selectively closed to prevent reduction in capacity. By injecting fluid into compressor 10 through EVI port 30, capacity of the compressor 10 may be increased over the capacity of the compressor 10.

When operating at a full capacity, valves 140, 144, 148, and 208 may be selectively closed such that the fluid follows a path as previously described from the discharge outlet 114, to the condenser 104, to the heat exchanger 108, to the evaporator 112, and back through the suction port 22.

When operating at a first lower level of capacity, valves 140, 144, and 148 may be selectively closed while valve 208 may be open. Fluid may pass as stated in full capacity mode. However, the portion of the compression pockets of wraps 50, 58 that are in communication with EVI port 30, 78 may now be in communication with line 132, thereby creating a leak path in the compression pockets to a suction pressure zone via line 90, line 204, and valve 208. Thus, by creating a leak path from compressor 10 through EVI port 30, a first compressed fluid may be leaked from a compression pocket to the suction pressure zone such that capacity of the compressor 10 may be reduced because the overall compression of the fluid within the compression chambers of the wraps 50, 58 is reduced.

When operating at a second lower level of capacity, valves 140 and 144 may be closed while valves 148 and 208 may be open to utilize the EVI port 30 and the bypass port 34. The process through the EVI port 30 may operate the same as previously described in the first lower level of capacity for system 200. Additional capacity reduction is provided through use of the bypass port 34, where a portion of a second compressed fluid exits the compressor 10 through the bypass port 34 before reaching full compression and discharge port 26. The amount of additional capacity reduction is dependent upon the amount of the second compressed fluid exiting another compression pocket; thus the amount of the second compressed fluid exiting the compressor 10 is dependent on the area and location of the bypass port 34. The second compressed fluid exits the bypass port 34 into line 98. The fluid passes through valve 148 and into line 132 to reenter the suction port 22.

A difference between the first compressed fluid that is leaked through the EVI port 30 and the second compressed fluid that exits through the bypass port 34 is directly related to the first and second compressed fluids being leaked at different points in the compression process. The EVI port 30 being located radially outward of the bypass port 34 causes the first compressed fluid to be less compressed than the second compressed fluid. Therefore the leaking of the first compressed fluid from the EVI port 30 creates less reduction in capacity than the leaking of the second compressed fluid from the bypass port 34, thus achieving different levels of capacity.

As previously mentioned, controller 134 selectively controls the opening and closing of valves 128, 140, 144, 148, and 208 to selectively open and close communication with the EVI port 30 and the bypass port 34. In other aspects, one or more of valves 128, 140, 144, 148, and 208 may be controlled by one or more additional controllers.

Now referring specifically to FIG. 11, system 300 may contain many of the same features as systems 100 and 200 including, but not limited to, condenser 104, heat exchanger 108, evaporator 112, valves 128,140, 144, and lines 90, 98, 116, 120, 124, 132, 136, and 204. Valve 304 may selectively communicate between lines 90, 98, 132, and 204, thus EVI port 30, bypass port 34, and suction port 22. Valve 304 may be a three-way valve having a first position which restricts communication between all of line 90, line 98, and line 132, a second position allowing communication between line 90 and line 132 while blocking communication between line 98 and 132, and a third position allowing line 90 and line 98 to communicate with line 132. Thus, valve 304 selectively allows or restricts communication between EVI port 30 and suction port 22 and bypass port 34 and suction port 22.

When operating at an economized capacity, fluid may selectively exit the compressor through the discharge outlet 114 into line 116. After passing through the condenser 104, the fluid may enter line 136 containing valve 140. The fluid continues in line 136 and passes through heat exchanger 108 and into line 90. Line 90 may further contain optional valve 144. The fluid is selectively injected back into compressor 10 through EVI port 30 to increase the compression of the fluid within the various compression pockets of wraps 50, 58. The injected fluid that is injected back into compressor 10 through EVI port 30 may be a vapor fluid, a liquid fluid or a combination vapor-liquid fluid (e.g. wet vapor).

Valve 304 along line 204 may be closed to prevent reduction in capacity. By injecting fluid into compressor 10 through EVI port 30, capacity of the compressor 10 may be increased over the capacity of the compressor 10.

When operating at a full capacity, valves 140, 144, and 304 may be closed such that the fluid follows a path as previously described from the discharge outlet 114, to the condenser 104, to the heat exchanger 108, to the evaporator 112, and back through the suction port 22.

When operating at a first lower level of capacity, valves 140 and 144 may be closed while valve 304 may allow communication between lines 204/90 and line 132. However, valve 304 may prevent communication with line 98. Fluid may pass as stated in the full capacity mode. However, the portion of the compression pockets of wraps 50, 58 that are in communication with EVI port 30, 78 may now be in communication with line 132, thereby creating a leak path in the compression pockets to a suction pressure zone via line 90, line 204, and valve 304. Thus, by creating a leak path from compressor 10 through EVI port 30, a first compressed fluid may be leaked from the compression pockets to the suction pressure zone such that capacity of the compressor 10 may be reduced because the overall compression of the fluid is reduced.

When operating at a second lower level of capacity, valves 140 and 144 may be closed while valve 304 may allow communication between line 98 and lines 204/132 and line 90 and lines 204/132. Capacity reduction is provided through use of the bypass port 34 and the EVI port 30, where a portion of a second compressed fluid exits the compressor 10 through the bypass port 34 and a portion of the first compressed fluid exits the compressor 10 through the EVI port 30 before reaching full compression and discharge port 26. The amount of first and second compressed fluids exiting the compressor 10 is dependent on the area and location of the bypass port 34. The second compressed fluid exits the bypass port 34 into line 98. The fluid passes through valve 304 and into line 132 to reenter the suction port 22.

As previously stated, a difference between the first compressed fluid that is leaked through the EVI port 30 and the second compressed fluid that exits through the bypass port 34 is directly related to the first and second compressed fluids being leaked at different points in the compression process. The EVI port 30 being located radially outward of the bypass port 34 causes the first compressed fluid to be less compressed than the second compressed fluid. Therefore the leaking of the first compressed fluid from the EVI port 30 creates less reduction in capacity than the leaking of the second compressed fluid from the bypass port 34, thus achieving different levels of capacity.

As previously mentioned, controller 134 may control the opening and closing of valves 128, 140, 144, and 304 to selectively open and close communication with the EVI port 30 and the bypass port 34. In other aspects, one or more of valves 128, 140, 144, and 304 may be controlled by one or more additional controllers.

In general, the present disclosure achieves benefits by utilizing a dual purpose EVI-bypass port and a secondary bypass port to achieve both economized and multiple bypass operations. The use of multiple EVI and/or bypass ports allow several levels of capacity reduction without the penalties associated with economized and bypass operation through a single port. In this way, the present disclosure improves upon the prior art.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system including a compressor, the compressor comprising:

an orbiting scroll member having a first end plate and a first spiral wrap;

a non-orbiting scroll member having a second end plate and a second spiral wrap, wherein the second spiral wrap forms a meshing engagement with the first spiral wrap to create a plurality of compression chambers between a suction port and a discharge port of the orbiting scroll member and the non-orbiting scroll member;

a first port in communication with a first of the plurality of compression chambers and selectively injecting an injection fluid into the first of the plurality of compression chambers to increase a compressor capacity and selectively leaking a first compressed fluid from the first of the plurality of compression chambers to reduce the compressor capacity;

a second port in communication with a second of the plurality of compression chambers and selectively leaking a second compressed fluid from the second of the plurality of compression chambers to reduce a compressor capacity;

a first passage in communication with the first port and a first fitting to transport fluid between the first of the plurality of compression chambers and the first fitting; and a second passage in communication with the second port and a second fitting to transport the second compressed fluid from the second of the at least one compression chamber.

2. The system of claim 1, further comprising a controller controlling a plurality of valves that control the selective injection of the injection fluid and the selective leaking of the first and second compressed fluids.

3. The system of claim 1, wherein the second port is not leaking the second compressed fluid when the first port injects the injected fluid into the first of the plurality of compression chambers.

4. The system of claim 1, wherein the second port is one of leaking the second compressed fluid or not leaking the second compressed fluid when the first port leaks the first compressed fluid from the first of the plurality of compression chambers to reduce the compressor capacity.

5. The system of claim 1, wherein the second port and the first port operate to reduce compressor capacity.

6. The system of claim 1, further comprising a first conduit in communication with the first fitting and a heat exchanger, wherein the first conduit transports compressed fluid from the heat exchanger to the first fitting.

7. The system of claim 6, further comprising an expansion valve positioned within the first conduit to permit or prevent communication between the heat exchanger and the first fitting.

8. The system of claim 1, further comprising a second conduit in communication with the first fitting and a suction pressure region, wherein the second conduit transports fluid from the first fitting to the suction pressure region.

9. The system of claim 8, further comprising a solenoid valve positioned within the second conduit to permit or prevent communication between the suction pressure region and the first fitting.

10. The system of claim 1, further comprising a third conduit in communication with the second fitting and a suction pressure region, wherein the third conduit transports fluid from the second fitting to the suction pressure region.

11. The system of claim 10, further comprising a second solenoid valve positioned within the third conduit to permit or prevent communication between the second fitting and the suction pressure region.

12. The system of claim 1, further comprising:

a first conduit in communication with the first fitting and a heat exchanger, wherein the first conduit transports a first compressed fluid from the heat exchanger to the first fitting;

a second conduit in communication with the first fitting and a suction pressure region, wherein the second conduit transports fluid from the first fitting to the suction pressure region; and a third solenoid valve that selectively permits or prevents flow between the first conduit and the suction pressure region, between the second conduit and the suction pressure region, or both the first and second conduits and the suction pressure region.

13. The system of claim 1, wherein at least one of the first port and the second port is one of a single larger port or a plurality of small ports grouped together.

14. The system of claim 1, wherein the first port is located radially outward relative to the second port.

15. A compressor comprising:

a first scroll member having a first end plate and a first spiral wrap;

a second scroll member having a second end plate and a second spiral wrap, wherein the second spiral wrap forms a meshing engagement with the first spiral wrap to create a plurality of compression chambers between the first scroll member and the second scroll member;

a first port injecting a fluid into a first of the plurality of compression chambers to increase a compressor capacity or leaking compressed fluid from the first of the plurality of compression chambers to reduce the compressor capacity;

a second port leaking compressed fluid from a second of the plurality of compression chambers to reduce the compressor capacity;

a first passage in communication with the first port and a first fitting to transport fluid between the first of the plurality of compression chambers and the first fitting; and a second passage in communication with the second port and a second fitting to transport the second compressed fluid from the second of the at least one compression chamber.

16. The compressor of claim 15, wherein the first port both injects the fluid into the first of the plurality of compression chambers to increase the compressor capacity and leaks compressed fluid from the first of the plurality of compression chambers to reduce the compressor capacity.

17. The compressor of claim 15, wherein the first port is a vapor injection port in communication with the first of the plurality of compression chambers and injects the fluid into the first of the plurality of compression chambers to increase the compressor capacity, and the second port is a bypass port in communication with the second of the plurality of compression chambers and leaks compressed fluid from the second of the plurality of compression chambers to reduce the compressor capacity.

18. The compressor of claim 15, wherein the first port is positioned radially outward relative to the second port.

* * * * *